United States Patent [19]

Sugimoto et al.

[11] 4,286,900

[45] Sep. 1, 1981

[54] INJECTION DEVICE OF CHEMICAL FLUIDS FOR IMPROVEMENTS OF THE GROUND

[75] Inventors: Akira Sugimoto, Funabashi; Hiroshi Sugimoto, Chiba, both of Japan

[73] Assignee: Tokyo Chika Koji Kabushiki Kaisha, Tokyo, Japan

[21] Appl. No.: 87,953

[22] Filed: Oct. 24, 1979

[51] Int. Cl.[3] ..... C09K 17/00; E02D 3/12

[52] U.S. Cl. ..... 405/269; 175/19

[58] Field of Search ..... 405/269, 266–268; 175/19, 21; 166/295, 294

[56] References Cited

U.S. PATENT DOCUMENTS

| | | | |
|---|---|---|---|
| 3,243,962 | 4/1966 | Ratliff | 405/269 X |
| 3,540,837 | 11/1970 | Pascucci | 405/269 X |
| 3,984,988 | 10/1976 | Portier | 405/269 |

FOREIGN PATENT DOCUMENTS

| | | | |
|---|---|---|---|
| 305235 | 4/1918 | Fed. Rep. of Germany | 405/269 |
| 561794 | 10/1932 | Fed. Rep. of Germany | 405/269 |
| 7085 | of 1914 | United Kingdom | 405/269 |
| 387084 | 8/1973 | U.S.S.R. | 405/269 |
| 414360 | 7/1974 | U.S.S.R. | 405/269 |

*Primary Examiner*—Stephen J. Novosad

*Attorney, Agent, or Firm*—Wenderoth, Lind & Ponack

[57] ABSTRACT

A chemical fluids injection device for improvements in the ground includes an outer pipe, for injecting fluid-A of two-fluids for improvements in the ground, and an inner pipe, for injecting fluid-B of the two chemical fluids, which are coaxially disposed. An annular recess is located on the outer circumference of the outer pipe, and the annular recess is in communication with a space located between the outer and inner pipes and a space located within the inner pipe, respectively, through a fluid-A injection port and a fluid-B injection port, respectively. There is a resilient annular member made of rubber or the like which is located in the annular recess.

3 Claims, 1 Drawing Figure

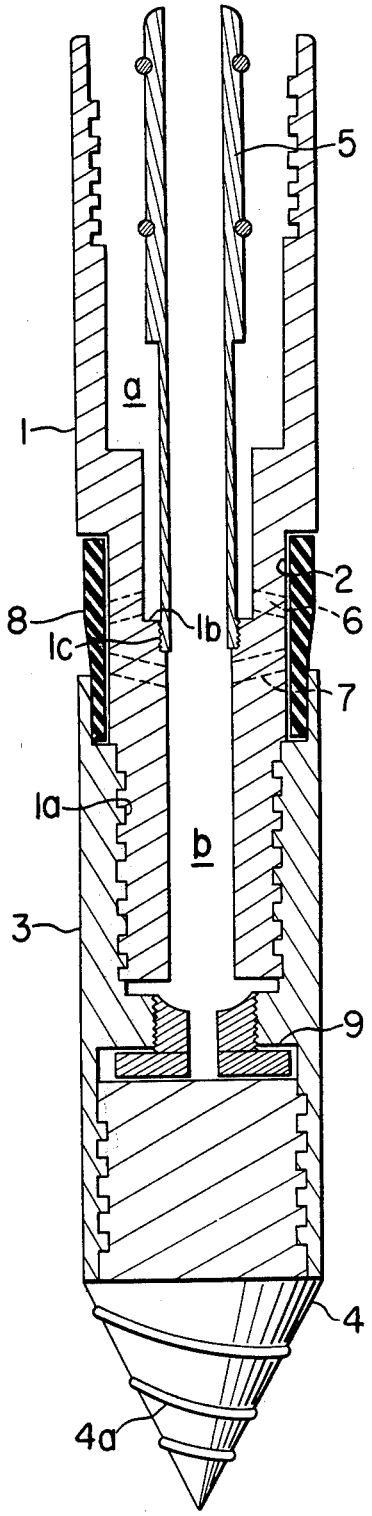
5
a
1
2
8
6
1b
1c
7
1a
b
3
9
4
4a

INJECTION DEVICE OF CHEMICAL FLUIDS FOR IMPROVEMENTS OF THE GROUND

BACKGROUND OF THE INVENTION

The present invention is directed to a ground improvement injection device which is capable of injecting chemical fluids into the ground, and more particularly to an injection device for use with dual-fluids mixing type of chemical fluids.

Injection devices of the dual-fluids mixing type for mixing chemical fluids for improvements in the ground are well known. In the prior art devices, however, when the injection device is driven into the ground through the use of a shoe which has excavating blades at the tip end of the device, there was a fear that earth and sand around the injection device would enter the interior of the injection device through an injection port or ports located thereon for allowing injection of the chemical fluids. In addition, to complicate matters, the two fluids which had been once mixed and injected into the ground could flow back into the injection device, and thus result in solidification of the two-fluids herein with a subsequent clogging of the injection device.

SUMMARY OF THE INVENTION

Therefore, it is a principal object of the present invention to provide a novel useful injection device of chemical fluids for improvements of the ground, which can precisely inject dual fluid mixing type of chemical fluids, for improving of the ground, into the desired ground without a resulting waste of the chemical fluids.

Another object of the present invention is to provide a novel injection device of the dual-fluids mixing type of chemical fluids for improvements of the ground, which can effectively prevent earth and sand around the injection device from entering into the interior of the device, and which can prevent said chemical fluids that have been once mixed and injected into the ground from flowing back through the injection port or ports into the interior of the injection device.

According to one feature of the present invention, there is provided an injection device of chemical fluids for improvements of the ground which includes an outer pipe for injecting fluid-A of the dual-fluids mixing type of chemical fluids for improvements of the ground, an inner pipe disposed coaxially with respect to said outer pipe for injecting fluid-B of the same chemical fluids, an annular recess located along the outer circumference of the outer pipe, a fluid-A injection port and a fluid-B injection port for placing the annular recess in communication with a space located between the outer and inner pipes and a second space located within the inner pipe, respectively, and a resilient annular member which is made of rubber or the like and is received in the annular recess.

Since the injection device according to the present invention is constructed as described above, when the fluid-A and fluid-B of the dual-fluids mixing type of chemical fluids are supplied under a pressure into the space between the outer and inner pipes and the space within the inner pipe, respectively, after the injection device has been driven into the desired ground at a desired depth, the respective injection ports for the fluid-A and fluid-B, respectively, are in communication with the annular recess located on the outer circumference of the outer pipe, a resilient annular member made of rubber or the like is received in the annular recess so that the respective injection ports are closed by the resilient annular member. Therefore, in the injection device of chemical fluids according to the present invention, there is no possibility that earth and sand around the injection device can enter the interior of the injection device upon the driving of the device into the ground.

When the fluid-A and fluid-B are supplied under a pressure into the respective spaces which are defined by the outer and inner pipes after the injection device has been driven into the ground as described above, the fluid-A and fluid-B cause the resilient annular member to radially expand as a result of the force through the fluid-A injection port and the fluid-B injection port, respectively and thus the fluids pass through the gap clearance between the resilient annular member and the annular recess, and after they have been fully mixed with each other in the gap clearance, they are injected into the ground around the outer circumference of the outer pipe of the injection device and are solidified, so that the ground is hardened and thus improved. Further, the mixture of the fluid-A and fluid-B which is injected into the ground around the outer pipe of the injection device and through the gap clearance between the resilient annular member and the annular recess is prevented from flowing back into the injection device due to the presence of the resilient annular member, and thus, the fluids are prevented from solidifying within the respective hollow spaces defined by the outer and inner pipes.

As described above, according to the present invention, the ground can be improved by making use of the dual-fluids mixing type of chemical fluids for improvement of the ground in combination with an injection device which has a relatively simple construction.

BRIEF DESCRIPTION OF THE DRAWING

The above-described and other features and advantages of the present invention will become more apparent by reference to the following description of its preferred embodiment taken in conjunction with the accompanying drawing consisting of a single FIGURE, which is a longitudinal cross-section view showing one preferred embodiment of the injection device of chemical fluids for improvements of the ground according to the present invention.

DETAILED DESCRIPTION OF THE INVENTION

Referring now to the single FIGURE of the drawing which shows the preferred embodiment of the present invention, reference numeral (1) designates an outer pipe, which has an annular recess (2) located on the outer circumference of its lower portion, and which includes a threaded portion 1(*a*) along the outer circumference below the recess (2). A lower pipe (3) is threadedly attached to the threaded portion (1*a*), and a shoe (4) which includes spiral excavating blades (4*d*) at its tip portion is threadedly secured to the bottom end of the lower pipe (3) for closing the bottom end of the space within the lower pipe (3).

Within the outer pipe (1) is disposed an inner pipe (5) which is coaxial therewith, and the outer circumference of the bottom end portion of the inner pipe (5) is threadedly secured to a lower inner circumferential threaded portion (1*c*) of a stepped portion (1*b*) which is located on the inner circumference of the outer pipe (1) in the middle of the annular recess (2), so that the interior of the inner pipe (5) is in communication with the space within the lower pipe (3) through a lower space (b) which is located within the outer pipe (1). Further, an upper space (a) which is located within the outer pipe (1) above the stepped portion (1*b*) has its inner circumference and bottom delimited by the inner pipe (5) and the stepped portion (1*b*).

There are a fluid-A injection port (6) and a fluid-B injection port (7) which have been drilled into the upper and lower portions of the circumferential wall of the pipe (1) which faces the annular recess (2) for communicating with the upper and lower spaces respectively and the annular recess (2) has a resilient annular member (8) which is made of rubber or the like received therein.

When the injection device is driven into the ground to a predetermined depth through the use of the shoe (4) which has the spiral excavating blades (4*a*) the fluid-A and fluid-B of the dual-fluids mixing type of chemical fluids for improvements of the ground are supplied under pressure into the space between the outer pipe (1) and the inner pipe (5) and into the space within the inner pipe (5). The fluid-A and fluid-B are then ejected out of the outer pipe (1) through the fluid-A injection port (6) and the fluid-B injection port (7), respectively, which are located in the recessed portion of the circumferential wall of the outer pipe (1). Subsequently, the chemical fluids cause the resilient annular member (8) to expand radially and separate from the recess as a result of the force exerted on it and are then injected into the ground through the gap clearance which is then formed between the resilient annular member (8) and the outer pipe (1) and thereby the fluids harden and the ground is improved.

During the above-described injection of the fluid-A and fluid-B, the two fluids are mixed with each other as they pass through the gap clearance which is formed between the resilient annular member (8) and the outer pipe (1), so that when they have been injected into the environmental ground the dual type chemical fluids, can be hardenejd. Further, the chemical fluids after having been injected into the ground, are prevented from flowing back into the injection device as a result of the presence of the resilient annular member (8) which has returned to its original position in the recess (2), and therefore, there is no possibility of the dual type chemical fluids hardening within the injection device.

It is to be noted that the described injection device can be modified in a manner such that a water jet type excavating member can be mounted to the lower pipe (3), and after the injection device has been driven into the ground with the aid of a water jet, a ball is made to fall within the inner pipe (5) so that the ball rests on a seat (9) which is located in the middle portion of the lower pipe (3) and which communicates with a bottom end space in the lower pipe (3) for mounting the water jet type excavating member. The liquid-A and liquid-B are then supplied under a pressure into the space between the outer pipe (1) and the inner pipe (5) and the space within the inner pipe (5), respectively.

While the present invention has been described in connection to one preferred embodiment, it is noted that the present invention is not limited to the illustrated embodiment and various changes in design could be made without departing from the spirit of the present invention.

What is claimed is:

1. An injection device for injecting a mixture of two fluids, fluid-A and fluid-B, into the ground for hardening the ground, said injection device comprising:

a hollow outer pipe for injecting the fluid-A therethrough, said hollow outer pipe having an inwardly stepped portion on the inside wall for defining an upper greater diameter space and a lower lesser diameter space within the hollow interior thereof said hollow outer pipe having means for sealing closed the lower end thereof and said hollow outer pipe further having an annularly extending recessed portion on the outer surface thereof;

a hollow inner pipe coaxially positioned within said hollow outer pipe within said upper greater diameter space, said hollow inner pipe sealingly connected at the lower end thereof to the inside wall of said hollow outer pipe at said inwardly stepped portion wherein the hollow interior of said hollow inner pipe communicates with said lower lesser diameter space for injecting fluid-B through said hollow inner pipe into said lower lesser diameter space; and resilient seal means located in said angularly extending recessed portion, said hollow outer pipe having first port means for connecting said upper greater diameter space with the exterior at said annularly extending recessed portion for allowing fluid-A to flow therethrough and second port means for connecting said lower lesser diameter space with the exterior at said annularly extending recessed portion for allowing fluid-B to flow therethrough, said resilient seal means for sealing said first and second port means closed when fluid-A and fluid-B are not being injected through said injection device and for defining a mixing chamber for mixing fluid-A and fluid-B and allowing the mixture to flow into the ground by expanding radially away from said annularly extending recessed portion.

2. An injection device as in claim 1 further comprising a shoe having excavating blades, said shoe connected to the lower end of said hollow outer pipe for moving dirt for allowing said injection device to be driven into the ground.

3. An injection device as in claim 1 wherein said hollow outer pipe has threads at said inwardly stepped portion and said hollow inner pipe has threads on the outer surface at the lower end thereof for threadingly and sealingly engaging said threads of said hollow outer pipe.

* * * * *